United States Patent [19]

Sakamoto et al.

[11] Patent Number: 4,763,720

[45] Date of Patent: Aug. 16, 1988

[54] MICROWAVE PROCESS FOR THE FABRICATION OF CORES FOR USE IN FOUNDRY CASTING

[75] Inventors: Toshio Sakamoto; Kanichi Sato; Yoshiyuki Takemura, all of Hirakata, Japan

[73] Assignee: Kabushiki Kaisha Komatsu Seisakusho, Tokyo, Japan

[21] Appl. No.: 86,192

[22] Filed: Aug. 17, 1987

Related U.S. Application Data

[63] Continuation of Ser. No. 878,512, Jun. 23, 1986, abandoned, which is a continuation of Ser. No. 636,957, Aug. 2, 1984, abandoned.

[51] Int. Cl.[4] ..... B22C 1/18; B22C 1/20

[52] U.S. Cl. ..... 164/525; 164/528; 164/15

[58] Field of Search ..... 164/525, 527, 523, 518, 164/15, 528; 156/38.35

[56] References Cited

U.S. PATENT DOCUMENTS 4,331,197 5/1982 Cole .

FOREIGN PATENT DOCUMENTS

| | | | |
|---|---|---|---|
| 55-45509 | 3/1980 | Japan | 164/15 |
| 57-75243 | 5/1982 | Japan | 164/525 |
| 57-115943 | 7/1982 | Japan | 164/525 |
| 57-115942 | 7/1982 | Japan | 164/525 |
| 57-137053 | 8/1982 | Japan | 164/525 |
| 2040959 | 9/1980 | United Kingdom | 164/525 |

*Primary Examiner*—Kuang Y. Lin

*Attorney, Agent, or Firm*—Armstrong, Nikaido, Marmelstein & Kubovcik

[57] ABSTRACT

For the fabrication of a disintegratable sand core, refractory particles such as silica sand are mixed with two binders, one consisting of an inorganic substance such as a silicate and the other consisting of a starch, and, preferably, with water. The two binders function to cancel the disadvantages arising from the use of only either. The mixture is introduced into a core box molded essentially of materials pervious to microwave energy. Exposed to microwave energy through the core box, the mixture hardens in the shape of the core box cavity. For the production of cores having greater surface stability at room temperature, the starch and water are first mixed together into a paste, and this paste is added to the refractory particles together with the inorganic binder, thereby assuring uniform dispersion of the starch throughout the mixture.

2 Claims, 3 Drawing Sheets

MICROWAVE PROCESS FOR THE FABRICATION OF CORES FOR USE IN FOUNDRY CASTING

This application is a continuation of application Ser. No. 878,512 filed June 23, 1986, now abandoned, which is a continuation of Ser. No. 636,957 filed Aug. 2, 1984, now abandoned.

BACKGROUND OF THE INVENTION

This invention relates to a process for the fabrication of a coherently bonded mass of sand or like refractory grains or particles, for use as a disintegratable core for combined use with a complementary mold in foundry casting applications, with the core being used for forming a passage or opening in castings. The invention is directed more specifically to such a process employing microwave energy for curing the bonded and contoured mass of refractory particles.

Sand molds and cores for metal casting applications must meet two contradictory requirements: They must be of high strength before and during the molding of molten metal but should readily disintegrate and allow easy shakeout following the solidification of the metal. A variety of mold and core compositions, as well as methods of making molds or cores, have been suggested in an attempt to fulfill the above and other requirements.

A typical conventional method dictates the bonding of refractory particles such as silica sand with an organic binder such as phenolic resin, furan resin, urethane resin and urea resin, and thermally curing the bonded refractory particles. Shell molding is one well known curing method, wherein a mixture of sand and thermosetting phenolic resin is poured over a heated metal pattern, with the result that a thin shell of the mixture sticks to the hot pattern surface. Microwave heating is another curing method, as disclosed for example in Cole U.S. Pat. No. 4,331,197. The use of organic binders for holding refractory particles together is objectionable, however, as the molds made therefrom, whether they have been cured by the hot pattern or microwave method, do not necessarily contract upon solidification of the cast metal to an extent sufficient to prevent the hot cracking of the casting. Moreover, being synthesized from petroleum, the above numerated organic binders are generally expensive and subject to excessive cost fluctuations.

In view of the limitations and restrictions of organic binders, recent research and development efforts in the molding industry have again been centered on inorganic binders notably including water glass (sodium silicate). However, molds or cores as so far fabricated with use of inorganic binders have had a problem with regard to their disintegration after the setting of the cast metal. The quality of the castings made with such molds or cores has also been inferior in some instances to that of the castings fabricated with the molds or cores prepared with use of organic binders.

Take, for instance, the conventional carbon dioxide method wherein a body of sand bonded with water glass is hardened by a carbon dioxide gas. As much as four to six percent water glass has normally been added to the sand to assure mold strength. The high proportion of water glass has sometimes resulted in the sintering of the molds or cores at the time of casting. The sintered molds or cores do not, of course, readily disintegrate, do make shakeout difficult, and may partly stick fast to the castings. Further the molds or cores prepared as above have been relatively poor in surface stability. Still further, in reconditioning, for reuse, the sand reclaimed from the used molds or cores, there has been the danger of bringing about pollution or contamination problems.

SUMMARY OF THE INVENTION

The present invention provides a novel method of fabricating a coherently bonded mass of refractory particles, suitable for use as a molding core, which is free from the hot cracking problem conventionally encountered in the case of the molds or cores made with use of organic binders only and which is superior in disintegration and surface stability characteristics to those made with use of inorganic binders only.

The method of this invention is also notable for the high efficiency with which molding cores can be fabricated, with use of appreciably less heating energy than heretofore.

Further the cores made in accordance with the invention are favorable in both surface stability and hot strength.

Still further the invention provides for the easy recycling of the refractory particles without giving rise to the pollution problem in reconditioning the refractory particles recovered from the used cores that have been made by the inventive method.

According to the method of this invention, stated in brief, there is first provided a mixture of refractory particles (sand) with 0.5–3.0% by weight of a first binder consisting of an inorganic substance, 0.5–2.0% by weight of a second binder consisting of a starch, and 0–5.0% by weight of water. The mixture is charged into a core box having a predetermined cavity configuration and designed for microwave curing. The core box containing the mixture is then exposed to microwave energy for curing the mixture.

Particular attention is directed to the fact the invention employs two binders, one consisting of an inorganic substance and the other consisting of a starch, for holding the refractory particles together. This fact, combined with the microwave curing of the mixture, makes it possible to make the proportion of the inorganic binder far less than that in the known sand mixtures containing only an inorganic binder, so that the core produced by the inventive method will not sinter from the heat of cast metal but will readily disintegrate following the setting of the metal. The combined use of the two binders results also in the substantial improvement of the surface stability of the core and further prevents the hot cracking of the casting which has been the problem with the cores or molds containing organic binders. Moreover, by controlling the amount of the inorganic binder, a desired degree of hot strength can be imparted to the resulting core to prevent the production of scabs that might take place if only a starch were used as a binder. The inventive method offers the additional advantage of requiring a shorter period of time for core production than the comparable prior art methods employing heat transfer for curing the sand mixtures.

The addition of water is preferably limited to the range of 0.5–3.0% by weight. The water addition in this smaller range has proved to result in further improvement in the characteristics of the core, notably surface stability and strength at room temperature.

A further feature of the invention resides in a method of preparing the mixture of the above ingredients preparatory to microwave curing. The starch and water are first mixed together into paste form in the required proportions. Then this paste is added, together with the inorganic binder, to the refractory particles, and then these ingredients are all intimately intermingled to provide the desired mixture to be charged into the core box for microwave curing. This method is preferred because it enables a more uniform dispersion of the starch, with the consequent improvement in the surface stability and other characteristics of the core produced resultantly.

Further, preferably, the starch for use in the inventive method is an alpha starch prepared by processing a natural starch. The use of an alpha starch has also proved to improve the surface stability and strength, both at room and elevated temperatures, of the core.

Preferred examples of the inorganic binder for use in the inventive method are silicates such as, typically, water glass and potassium silicate. Potassium silicate in particular is effective to avoid the pollution problem in reconditioning the refractory particles recovered from the core after use.

The above and other features and advantages of this invention and the manner of realizing them will become more apparent, and the invention itself will best be understood, from a study of the following description and appended claims taken together with the attached drawings.

DETAILED DESCRIPTION

Core Composition

The core materials in accordance with the invention consist essentially of refractory particles, an inorganic substance as a first binder, a starch as a second binder, and water. The weight percentages of the first and the second binders and water with respect to the refractory particles are 0.5–3.0, 0.5–2.0, and 0–5.0 (preferably 0.5–3.0), respectively.

The refractory particles can take the form of either silica sand, zircon sand, alumina sand, or mullite. These sands may be either fresh or recovered ones. The recovered sands may or may not be reconditioned. Even these recovered sands, either reconditioned or otherwise, which contain dielectric substances are also acceptable.

Preferred examples of the inorganic binder are silicates such as water glass and potassium silicate. Water glass is recommended in applications where low manufacturing costs are essential, because it is relatively easily available commercially at small cost. Potassium silicate, on the other hand, lends itself to use in applications where the pollution or contamination problem in the recovery and reconditioning of the used cores must be avoided.

A starch for use as the second binder may be chosen from among natural starches (e.g. those derived from wheat, rye, rice, corn or maize, potato, and tapioco), processed starches, cellulosic starches (e.g. carboxymethyl cellulose), or synthetic, water soluble high polymer starches (e.g. those composed principally of polyvinyl alcohol). Particularly desirable, however, are alpha starches (e.g. alpha corn starch) obtained by processing natural starches, as they are effective to enhance the strength of the cores produced resultantly.

Process of Core Making

The following is a preferred procedure through which cores may be made in accordance with the invention:

1. There is first prepared a mixture consisting of 0.5–2.0% by weight of starch and up to 5% (preferably 0.5–3.0% ) by weight of water, both with respect to the amount of refractory particles to be mixed therewith. The starch and water are intermingled into paste form.

2. The above pasty starch and an inorganic binder are added to the refractory particles, the concentration of the inorganic binder being 0.5–3.0% by weight with respect to the amount of the refractory particles. All the ingredients are well intermingled.

Figure 1:
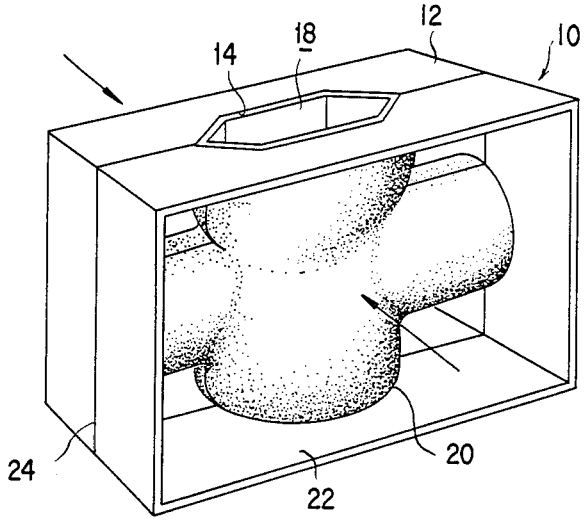
FIG. 1 is a perspective view of an example of core box in which bonded refractory particles may be changed to be molded into desired shape in accordance with the invention, the core box being further designed for effectively exposing the charged mixture to microwave energy for curing.
Figure 2:
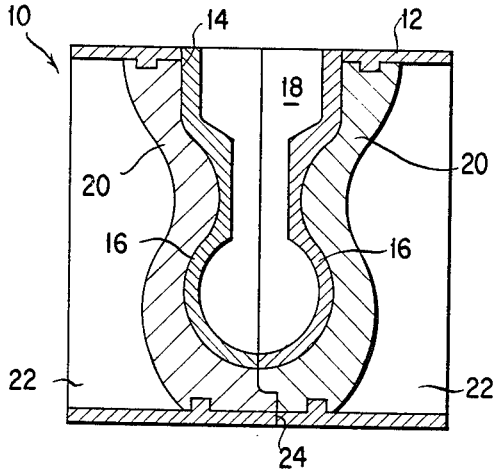
FIG. 2 is a vertical section through the core box of FIG. 1.

3. The above prepared mixture is charged into a core box having a desired cavity configuration, either by hand, by blowing, or by any other method. The core box should preferably be the one designed exclusively for the microwave curing of the charged mixture, easy permeable to microwave energy. FIGS. 1 and 2 show an example of core box suitable for use in the practice of this invention. This core box will be detailed subsequently.

4. The core box containing the mixture is introduced into a microwave oven, in which the mixture is irradiated with microwave energy through the core box. As is well known, the water contained in the mixture serves as the dielectric material for converting the microwave energy into heat energy, so that the mixture hardens in the shape of the core box cavity. The core box itself is so designed as not to emit much heat, as will be later explained in further detail.

5. The core box with the cured mixture (core) therein is withdrawn from the microwave oven.

6. The core is withdrawn from the core box.

Cores formed through the foregoing procedure in accordance with the invention have sufficient strength just after microwave curing to lend themselves to immediate use in metal casting.

One of the advantages of the cores fabricated as above is extremely high surface stability due to the use of a starch in addition to an inorganic binder and to the microwave curing of the sand mixture. The improved surface stability of the cores in accordance with the invention practically eliminates the casting defect known as sand holes (the entrapping in the casting of the sand that has been eroded from the core). The destruction of the core after the casing operation is also easier than in cases where sand is bonded by inorganic binders only as in some prior art core or mold compositions. Further the use of an inorganic binder in combination with starch in accordance with the invention makes it possible to adjustably vary the hot strength of the cores, so that the production of scabs on castings can be made far less than that in cases where only a starch is used as a binder. The microwave curing of the bonded refractory particles yields the additional advantage that, since microwave energy can rapidly heat the body of the mixture from within, the concentrations of the binders can be reduced to approximately 20–50% of the binder concentrations in the case of the prior art methods relying on heat transmission for curing.

Core Box

With reference to both FIGS. 1 and 2 the core box 10 illustrated therein is particularly well suited for use in the practice of the inventive method, for molding the bonded refractory mixture into desired shape and for exposing the same to microwave energy. The core box 10 is not new, however, the method of its manufacture being described and claimed in Japanese Patent Application No. 56-37215 filed on Mar. 17, 1981, and in corresponding U.S. Patent Application Ser. No. 357,273 filed on Mar. 11, 1982. The construction of the core box 10 will therefore be described only insofar as is necessary for a full understanding of the present invention.

The core box 10 has a rectangular frame 12 of rigid material, preferably metal, which is open on both sides. The metal frame 12 is apertured at 14 for pouring the bonded refractory mixture to be molded and cured. Within the metal frame 12 there is provided a relatively thin facing layer 16 defining a cavity 18 of the desired shape into which the mixture is to be formed. The aperture 14 in the metal frame 12 is open directly to the cavity 18. The facing layer 16 is enclosed in a backing layer 20 having a greater thickness than the facing layer and serving to reinforce the facing layer and to mechanically join the same to the metal frame 12. The backing layer 20 need not be of excessively large thickness as the metal frame 12 also functions to reinforce and protect the facing layer 16. The facing layer 16 and backing layer 20 should both be molded of materials pervious to microwave energy. A preferred example of material for the facing layer 16 is heat-resistant silicone rubber, and that for the backing layer 20 is suitably proportioned mixture of nonpolar epoxy resin and dry silica sand, cured in situ by heating.

In the core box 10 constructed as in the foregoing, the baking layer 20 enveloping the facing layer 16 is mostly exposed through the pair of opposite side openings 22 of the metal frame 12. Thus, irradiated through these openings 22 without being substantially affected by the metal frame 12, microwave energy will easily penetrate the backing layer 20 and then the facing layer 16 and will be effectively converted into heat energy in the refractory mixture that has been charged into the cavity 18 through the aperture 14 in the metal frame 12. The core box itself will not generate much heat.

At 24 is shown a parting line along which the core box 10 may be split into a pair of halves for the withdrawal of the cured mixture or core. The core halves may be held against each other following the withdrawal of one completed core, and the next batch of bonded refractory mixture may be charged into the cavity 18 for the fabrication of the next core. A large number of cores of the same shape and size can thus be manufactured by the same core box.

Reference is directed to the aforementioned Japanese Patent Application No. 56-37215 or U.S. patent application No. 357,273 for a detailed discussion of the method of making the core box 10.

The following is the description of some specific procedures actually adopted by the present applicant to produce cores in accordance with the method of this invention. These procedures represent, however, merely illustrative examples of the inventive method.

EXAMPLE I OF INVENTIVE METHOD

Silica sand was admixed with 1.0% by weight of water glass as a first binder, 1.0% by weight of alpha corn starch as a second binder, and 2.0% by weight of water. After well intermingling the listed ingredients, the water glass and starch bonded sand mixture was blown into a core box which was constructed in accordance with the teachings of FIGS. 1 and 2 but which had a cylindrical cavity with a diameter of 50 millimeters (mm) and a length of 50 mm. The core box containing the mixture was introduced into a microwave oven, in which the mixture was cured by exposure to microwave energy at 30 kilowatts (kw) for three minutes and 18 seconds.

The cores fabricated as above were then used for steel casting. After the usual vibratory shakeout process for castings were inspected for the attachment of sand and were found to be nearly free from sand. The sand that had been attached to the castings could be thoroughly removed by the application of shake-out shots.

Figure 3:
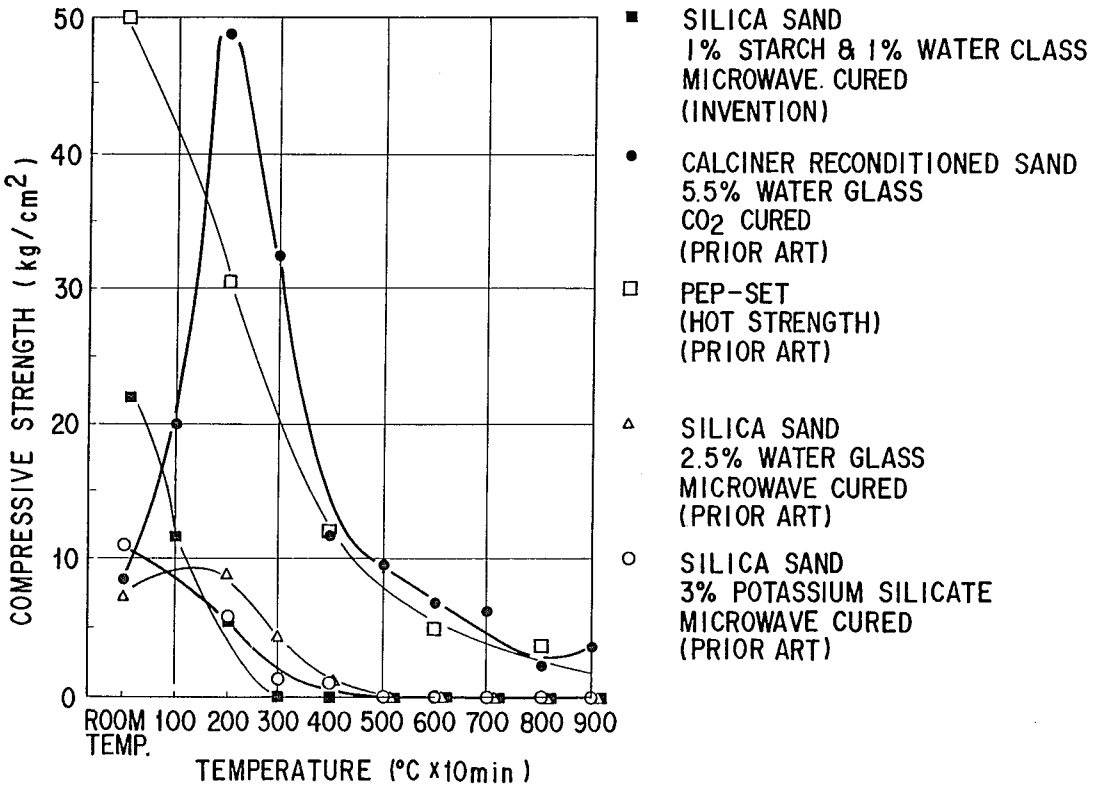
FIG. 3 is a graph plotting the strength of cores fabricated by the inventive method, and of those fabricated by some pertinent prior art methods, at various temperatures.

FIG. 3 is a graphic illustration of the compressive strengths, at various temperatures, of the cores fabricated as above and, by way of comparison, of those prepared by some related prior art methods. It will be seen from this graph that the strength of the inventive cores at room temperature is sufficiently high, being 22 kilograms per square, centimeter ($kg/cm^2$). The strength of the inventive cores rapidly decreases with temperatures, and the residual strength at 300° C. is zero. This attests to the favorable disintegration characteristic of the inventive cores after use for metal casting.

The prior art methods tested by way of comparison in this Example were as follows:

1. The sand recovered from used green sand and reconditioned by a calciner was mixed with 5.5 wt. % water glass, and the mixture was cured by carbon dioxide gas.
2. "Pep-set" (trademark for the product manufactured by Ashland Chemical Co., of the U.S.) organic cores prepared by a process analogous with the cold box method.
3. Fresh silica sand (Mikawa 5.6) was mixed with 2.5 wt. % water glass, and the mixture was microwave cured.
4. Fresh silica sand (Mikawa 5.6) was mixed with 3 wt. % potassium silicate, and the mixture was microwave cured.

Figure 4:
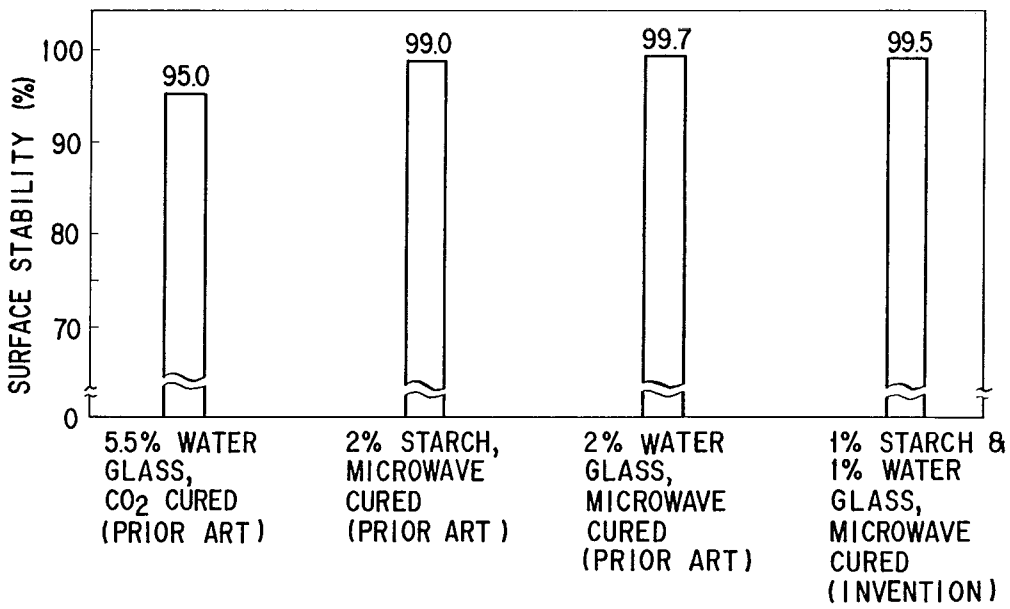
FIG. 4 is a graph plotting the surface stability of cores fabricated by the inventive method and of those fabricated by some related prior art methods.

FIG. 4 graphically represents the surface stability of cores fabricated through the procedure of Example 1 and of those by some associated prior art methods. The surface stability was tested by rolling cylindrical test pieces, each having a diameter of 50 mm and a length of 50 mm, over an approximately 10-mesh sieve for 24 hours. FIG. 4 gives the ratios of the weights of the thus treated test pieces to their initial weights in percent. The surface stability of the cores in accordance with the invention has proved to be sufficiently high (99.5%) in comparison with those of the prior art cores.

EXAMPLE II

Silica sand (Yunotsu) was mixed with water glass, alpha starch, and water in various sets of proportions set forth in the Table below. In preparing these mixtures the silica sand was charged into a commercially available universal mixer and was agitated for 30 seconds for the uniform dispersion of the various size grains. Then a pasty mixture of starch and water, prepared separately, was charged into the mixer, and these were intermingled for two minutes. Then water glass was introduced into the mixer, and the materials were intermingled for five minutes.

The water glass and starch bonded sand mixture prepared as above was then introduced into a core box of the same construction as that used in Example I. Then the core box containing the mixture was placed in a microwave oven, in which the mixture was subjected to microwave energy at 7 kw for two minutes.

The following Table lists the compressive strengths, at room temperature, of the cores of several different compositions fabricated as above:

| | Compressive Strength (kg/cm$^2$) | | | |
|---|---|---|---|---|
| | Alpha Starch (parts) | | | |
| Water Glass (parts) | 0.5 | 1.0 | 2.0 | 3.0 |
| 0.5 | — | 9.8 | 18.0 | 29.3 |
| 1.0 | 11.2 | 18.3 | 26.0 | 31.1 |
| 2.0 | 40.8 | 38.2 | 57.6 | 52.4 |
| 3.0 | 46.6 | 58.1 | 64.4 | — |
| 4.0 | 90.9 | 85.1 | — | — |
| 5.0 | 134.5 | 93.2 | — | — |
| | 1.0 | 2.0 | 4.0 | 4.5 |
| | Water (parts) | | | |

From the above tabulated results, as well as from the results of additional experimentation conducted by the applicant, the proportions of an inorganic binder and starch are set in the range of 0.5–3.0 wt. % and 0.5–2.0 wt. %, respectively, with respect to the amount of refractory particles. Further the addition of water is limited to the range of 0–5.0, preferably 0.5–3.0, wt. %.

It will be understood that the foregoing detailed disclosure is illustrative only and not to be taken as a definition of scope of the present invention. Departures from the disclosure may be made within the scope of the invention.

What is claimed is:

1. A process for making a core for use in metal casting, which comprises:
   (a) providing a mixture consisting essentially of refractory particles, 0.5 to 1.0% by weight of a first binder consisting of an inorganic substance, 0.5 to 1.0% by weight of a second binder consisting of a starch, and 0 to 2.0% by weight of water, the mentioned proportions of the first and second binders and water being all with respect to the refractory particles;
   (b) intimately intermingling the listed ingredients;
   (c) charging the mixture into a core box having a cylindrical cavity configuration with a diameter of 50 mm and a length of 50 mm and designed for effective exposure of the charged mixture to microwave energy; and
   (d) curing the mixture by exposing the core box containing the mixture to microwave energy at 30 kw for 3 minutes and 18 seconds, thereby providing a core having a compressive strength of 22 kg/cm$^2$.

2. A process for making a core for use in metal casting, which comprises:
   (a) providing a mixture consisting essentially of refractory particles, 0.5–3.0% by weight of a first binder consisting of an inorganic substance, 0.5–2.0% by weight of a second binder consisting of a starch, and 0–5.0% by weight of water, the mentioned proportions of the first and second binders and water being all with respect to the refractory particles;
   (b) charging the mixture into a core box having a predetermined cavity configuration and designed for effective exposure of the charged mixture to microwave energy; and
   (c) curing the mixture by exposing the core box containing the mixture to microwave energy at 7 kw for two minutes, thereby producing a core having a compression strength of between 9.8 and 64.4 kg/cm$^2$.

* * * * *